US008322705B2

(12) United States Patent
Oka et al.

(10) Patent No.: US 8,322,705 B2
(45) Date of Patent: Dec. 4, 2012

(54) IMAGE FORMING APPARATUS

(75) Inventors: Henrique Massanori Oka, Fujinomiya (JP); Kazushi Nishikata, Odawara (JP); Kei Sawanaka, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 120 days.

(21) Appl. No.: 12/847,218

(22) Filed: Jul. 30, 2010

(65) Prior Publication Data

US 2011/0031680 A1 Feb. 10, 2011

(30) Foreign Application Priority Data

Aug. 7, 2009 (JP) ..... 2009-185131

(51) Int. Cl.
*B65H 3/06* (2006.01)

(52) U.S. Cl. ..... 271/118; 271/117

(58) Field of Classification Search ..... 271/117, 271/118, 126, 127, 147, 152, 160
See application file for complete search history.

(56) References Cited

U.S. PATENT DOCUMENTS

| | | | | |
|---|---|---|---|---|
| 5,893,555 | A * | 4/1999 | Kawada et al. | 271/117 |
| 5,988,628 | A * | 11/1999 | Mori | 271/117 |
| 6,254,081 | B1 * | 7/2001 | Rasmussen et al. | 271/96 |
| 6,493,534 | B2 | 12/2002 | Sawanaka et al. | |
| 6,877,742 | B2 | 4/2005 | Nishikata et al. | |
| 7,032,900 | B2 | 4/2006 | Nishikata et al. | |
| 7,594,651 | B2 * | 9/2009 | Hall et al. | 271/117 |
| 7,597,316 | B2 * | 10/2009 | Nakahata et al. | 271/152 |
| 7,686,291 | B2 * | 3/2010 | Miyazawa | 271/117 |
| 2006/0180987 | A1 * | 8/2006 | Hattori | 271/117 |
| 2009/0166966 | A1 | 7/2009 | Nishikata et al. | |
| 2010/0059929 | A1 * | 3/2010 | Okumura | 271/117 |

FOREIGN PATENT DOCUMENTS

JP 11-301864 11/1999

* cited by examiner

*Primary Examiner* — Prasad Gokhale

(74) *Attorney, Agent, or Firm* — Fitzpatrick, Cella, Harper & Scinto

(57) ABSTRACT

A controller sets a pressure-contact time from memory in accordance with rigidity of a sheet and starts a feeding operation of a sheet by causing a feeding roller to be pressure contacted with sheets on a sheet stacking plate. The controller controls the feeding roller to be separated from the sheets on the sheet stacking plate after passage of the pressure-contact time. In this way, it is possible to set the optimum pressure-contact time at the time of feeding sheets in accordance with the kind of sheet being fed and realize a stable feeding operation. Since the controller controls a driving unit based on a detection signal of a sheet-surface detecting flag that detects the height of the uppermost surface of a sheet bundle, it is possible to realize the stabilization and acceleration of a contacting operation.

6 Claims, 15 Drawing Sheets

EXAMPLE OF PRESSURE-CONTACT TIME t2

| | THIN SHEET (55g/m2 TO 75g/m2) | NORMAL SHEET (75g/m2 TO 105g/m2) | THICK SHEET (105g/m2 TO 250g/m2) |
|---|---|---|---|
| t2 | 0.2 (s) | 0.25 (s) | 0.3 (s) |

IMAGE FORMING APPARATUS

BACKGROUND OF THE INVENTION

1. Field of the Invention

The present invention relates to an image forming apparatus having a sheet feeding device that feeds sheets stacked on a sheet stacking portion while separating the sheets from the uppermost sheets being stacked on the sheet stacking portion.

2. Description of the Related Art

In the related art, a sheet feeding device is incorporated into an image forming apparatus that forms images on sheets by an electrophotographic process, for example, so as to supply the sheets one by one to an image forming portion that forms images on the sheets. For example, the sheet feeding device includes a sheet cassette in which sheets are accommodated, a feeding roller that feeds sheets from the sheet cassette, and a friction separation portion that is provided pressure contacted with the feeding roller. When the uppermost sheets being fed by the feeding roller are conveyed, there is a case where the next sheet disposed thereunder is fed in an accompanied manner (which will be referred to as an accompanied feeding). In such a case, the uppermost sheets are separated into one sheet at a separation nip between the feeding roller and the friction separation portion and conveyed.

In this configuration, when the sheets are fed continuously in a state where the feeding roller is pressure contacted with the sheets, the next sheet which is fed in an accompanied manner with the sheet being fed will be continuously fed in the accompanied manner and pass through the separation nip, thus causing a multiple feeding. In the related art, this multiple feeding problem was solved by releasing the pressure-contact between the feeding roller and the sheet during the period when the sheets are conveyed by the feeding roller, thus preventing the accompanied feeding of the next sheet.

A sheet feeding device is known having a configuration in which the pressure-contact between the feeding roller and the sheet is released during the sheet feeding operation. According to this sheet feeding device, a pressing plate which is a sheet stacking portion having sheets placed thereon is supported to be pivotable upward and downward about a pivot shaft. The pressing plate is pivoted upward by being urged by a pressing plate spring. When the pressing plate is pivoted upward, the uppermost sheet comes into contact with the feeding roller, and the sheet is fed by rotation of the feeding roller. During the period when the sheet is being fed, the pressing plate is depressed by a pressing plate releasing cam being rotated by driving of a motor and is separated from the feeding roller. In this way, it is possible to prevent the accompanied feeding of the next sheet subsequent to the sheet being fed by the feeding roller and suppress a multiple feeding of sheets. This technique is described in Japanese Patent Application Laid-Open No. H11-301864.

However, when the sheet being fed are thin sheets (for example, having a basis weight of 75 g/m$^2$ or smaller), the leading end of the next sheet being fed in the accompanied manner will be folded and/or rolled by coming into contact with a conveyance guide in front of the separation nip. When the timing of separating the feeding roller from the sheet is accelerated to comply with the feeding of the thin sheet, a thick sheet (for example, having a basis weight of 105 g/m$^2$ or more) is not easily caught at the separation nip since the sheet is thick and rigid. Thus, the thick sheet will not be fed properly. Particularly, this phenomenon will become prominent as the sheet becomes thicker and more rigid.

SUMMARY OF THE INVENTION

The present invention provides an image forming apparatus having a sheet feeding device that realizes a stable feeding operation by setting an optimum contact time at the time of feeding sheets in accordance with the kind of sheet being fed.

According to an aspect of the present invention, there is provided an image forming apparatus including a sheet stacking portion that stacks sheets thereon; a feeding roller that pressure contacts with and separates from the stacked sheets, and the feeding roller configured to feed a sheet by being pressure contacted with the sheet; a separation portion that separates sheets being fed from the feeding roller; an information storage portion that stores information on a pressure-contact time of the stacked sheets with the feeding roller, the time being set in advance so as to increase as rigidity of the sheet increases; and a controller that sets the pressure-contact time from the information storage portion in accordance with the rigidity of the sheet to be fed, starts a feeding operation of the sheet by causing the feeding roller to be pressure contacted with the stacked sheets, and separates the feeding roller from the stacked sheets after the passage of the set pressure-contact time.

Further features of the present invention will become apparent from the following description of exemplary embodiments with reference to the attached drawings.

BRIEF DESCRIPTION OF THE DRAWINGS

FIGS. 6A and 6B illustrate a driving unit that lifts the sheet stacking plate, in which FIG. 6A illustrates a perspective view as viewed from the front side of the driving unit, and FIG. 6B illustrates a perspective view as viewed from the rear side of the driving unit with a rear frame thereof later being removed.

DESCRIPTION OF THE EMBODIMENTS

Embodiments of the present invention will now be described in detail in accordance with the accompanying drawings.

(First Embodiment)

Figure 1:
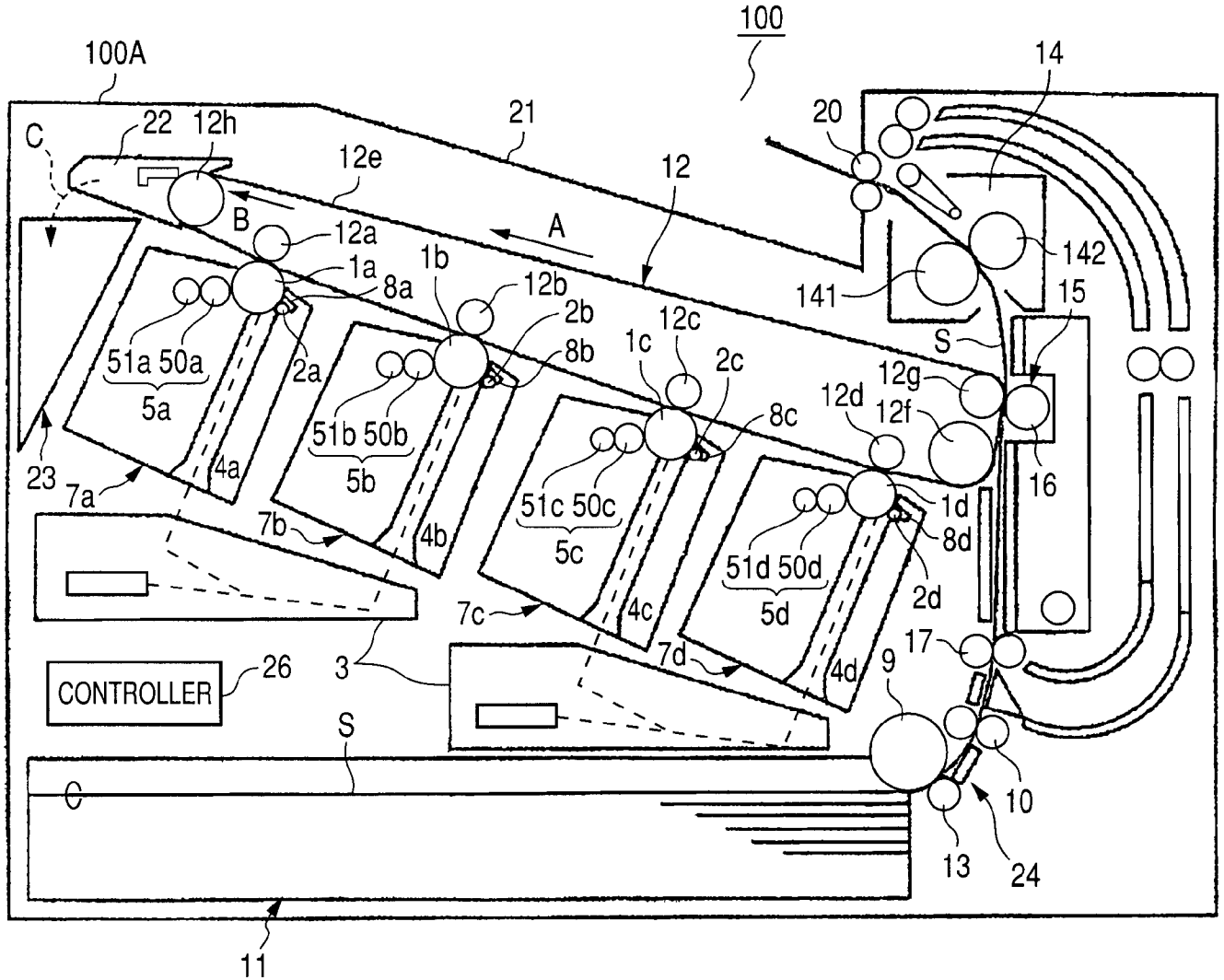
FIG. 1 illustrates a schematic sectional view of an image forming apparatus according to a first embodiment of the present invention.

As illustrated in FIG. 1, a color image forming apparatus 100 according to the first embodiment includes an image forming apparatus main body 100A (hereinafter also referred to as an apparatus main body) and process cartridges 7*a*, 7*b*, 7*c*, and 7*d* which are detachable from the apparatus main body 100A. In the apparatus main body 100A, a controller 26 is arranged so as to control the overall operation of the entire body of image forming apparatus 100. The four process cartridges 7*a* to 7*d* have the same structure, except that they form images with toners of different colors, namely yellow (Y), magenta (M), cyan (C), and black (Bk). The process cartridges 7*a* to 7*d* include drum units 4*a*, 4*b*, 4*c*, and 4*d* and developing units 5*a*, 5*b*, 5*c*, and 5*d*, respectively. The drum units 4*a* to 4*d* have photosensitive drums 1*a*, 1*b*, 1*c*, and 1*d* which are image bearing members, charge rollers 2*a*, 2*b*, 2*c*, and 2*d*, drum cleaning blades 8*a*, 8*b*, 8*c*, and 8*d*, and waste toner containers (not illustrated), respectively.

The developing units 5*a* to 5*d* have developing rollers 50*a*, 50*b*, 50*c*, and 50*d* and developer applying rollers 51*a*, 51*b*, 51*c*, and 51*d*. Two scanner units 3 are disposed under the process cartridges 7*a* to 7*d*. The scanner units 3 expose the photosensitive drums 1*a* to 1*d* with light based on image signals. After the photosensitive drums 1*a* to 1*d* are charged with a predetermined negative-polarity potential by the charging rollers 2*a* to 2*d*, the scanner units 3 form electrostatic latent images on the photosensitive drums 1*a* to 1*d*. The electrostatic latent images are subjected to reversal development by the developing units 5*a* to 5*d*, whereby negative-polarity toners adhere thereto, and toner images of the colors Y, M, C, and Bk are formed on the photosensitive drums 1*a* to 1*d*.

In an intermediate transfer belt unit 12, an intermediate transfer belt 12*e* is stretched around a driving roller 12*f*, a secondary transfer opposing roller 12*g*, and a tension roller 12*h*. The tension roller 12*h* applies tension in the direction indicated by arrow B. At the inner side of the intermediate transfer belt 12*e*, primary transfer rollers 12*a*, 12*b*, 12*c*, and 12*d* are arranged so as to oppose the respective photosensitive drums 1*a* to 1*d*, and a transfer bias is applied by a bias application portion (not illustrated). The toner images formed on the photosensitive drums 1*a* to 1*d* are conveyed to a secondary transfer portion 15 as described below when the respective photosensitive drums rotate, the intermediate transfer belt 12*e* rotates in the direction indicated by arrow A, and a positive-polarity bias is applied to the primary transfer rollers 12*a* to 12*d*. That is, starting with the toner image on the photosensitive drum 1*a*, the toner images are primarily transferred sequentially onto the intermediate transfer belt 12*e* and conveyed up to the secondary transfer portion 15 in a state where the toner images of the four colors are overlapped.

A feeding and conveying device 24 has a feeding roller 9 that feeds sheets S from a sheet cassette 11 which is disposed on the apparatus main body 100A side so as to accommodate the sheets S and a conveying roller 10 that conveys the sheets S being fed. The sheets S conveyed from the feeding and conveying device 24 are conveyed to the secondary transfer portion 15 by a resist roller pair 17. The feeding roller 9 is configured to be pressure contacted with and be separated from the sheets S stacked on a sheet stacking plate 110 which is a sheet stacking portion. The feeding roller 9 constitutes a feeding roller that feeds the sheets S by being pressure contacted therewith. In the secondary transfer portion 15, when a positive-polarity bias is applied to a secondary transfer roller 16, toner images of the four colors on the intermediate transfer belt 12*e* are secondarily transferred onto the conveyed sheet S. The sheet S having the toner images transferred thereto is conveyed to a fixing device 14 and heated and pressurized by a fixing roller 141 and a pressure roller 142, whereby the toner images are fixed to the surface of the sheet S. The sheet S having the toner images fixed thereto is discharged to a discharge tray 21 by a discharge roller pair 20. On the other hand, toners remaining on the surfaces of the photosensitive drums 1*a* to 1*d* after the toner images are transferred are removed by drum cleaning blades 8*a* to 8*d*, respectively. Moreover, a toner remaining on the intermediate transfer belt 12*e* after the toner images are secondarily transferred to the sheet S is removed by a transfer belt cleaning device 22. The removed toners pass through a waste toner conveyance path (indicated by broken arrow C in the figure) and are collected in a waste toner collecting container 23.

Figure 2:
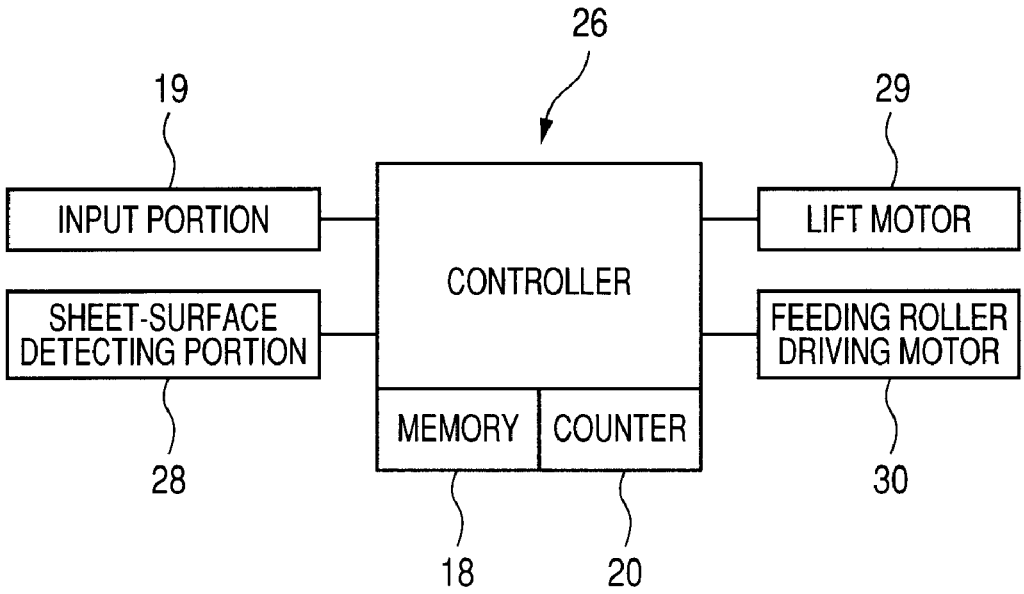
FIG. 2 illustrates a block diagram of a control system of the image forming apparatus.
Figure 12:
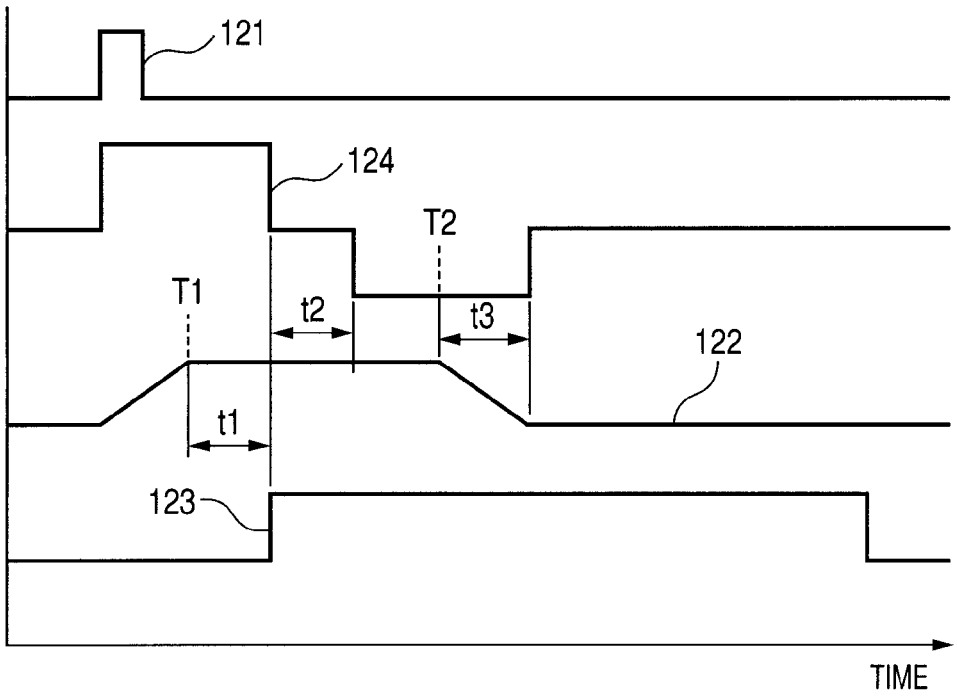
FIG. 12 illustrates a time chart illustrating the operations in the first embodiment.

FIG. 2 illustrates a block diagram of the control system arranged in the image forming apparatus 100. As illustrated in FIG. 2, a controller 26 provided in the apparatus main body 100A has a memory 18 and a counter 20. The memory 18 constitutes an information storage portion and stores information on a pressure-contact time t2 with the feeding roller 9, of the sheets stacked on the sheet stacking plate 110, which is set in advance so as to increase as the rigidity of the sheet increases. The pressure-contact time t2 is set in advance to a value that is optimized for each kind of sheet. The counter 20 counts a predetermined time t1, the pressure-contact time t2, and a predetermined time t3 respectively which are illustrated in FIG. 12.

The controller 26 sets the pressure-contact time t2 from the memory 18 in accordance with the rigidity of the sheet to be fed and starts feeding the sheet by causing the feeding roller 9 to be pressure contacted with the sheet stacked on the sheet stacking plate 110. Moreover, the controller 26 controls a driving unit 31 (FIGS. 6A and 6B) so as to separate the feeding roller 9 from the sheet stacked on the sheet stacking plate 110 after the passage of the set pressure-contact time t2. That is, the controller 26 causes the counter 20 to start counting the pressure-contact time t2 after the passage of the predetermined time t1 (after the predetermined time) from time T1 (see FIG. 12) when the controller 26 moves up the sheet stacking plate 110, and a sheet-surface detecting portion (sheet detecting portion) 28 detects the uppermost position of the sheets. In addition, the controller 26 moves down the sheet stacking plate 110 when the counter 20 has counted a count number corresponding to the pressure-contact time t2. That is, the controller 26 controls the operation of the driving unit 31 based on the information from the memory 18 so that the contact time of the sheet on the sheet stacking plate 110 increases as the rigidity of the sheet increases.

In the present embodiment, the sheet stacking plate 110 is provided to be movable up and down in a state where sheets S are stacked thereon, and a spring (elastic member) 112 is provided so as to urge the sheet stacking plate 110 towards the feeding roller 9. The sheets stacked on the sheet stacking plate 110 are pressure contacted with the feeding roller 9 by elastic force of the spring 112, and the sheet stacking plate 110 is moved down after the passage of the pressure-contact time t2. In this way, the sheets S stacked on the sheet stacking plate 110 are separated from the feeding roller 9.

The controller 26 is connected to an input portion 19, the sheet-surface detecting portion 28, a lift motor 29, and a feeding roller driving motor 30. Specifically, the controller 26 causes the counter 20 to start counting the pressure-contact time t2 (FIG. 12) after the passage of the predetermined time t1 (FIG. 12) from time T1 when the controller 26 moves up the sheet stacking plate 110, and a sheet-surface detecting flag 115 (FIG. 3) detects the uppermost sheet on the sheet stacking plate 110. The controller 26 starts moving down the sheet stacking plate 110 in order to separate the sheets on the sheet stacking plate 110 from the feeding roller 9. In addition, the controller 26 stops moving down the sheet stacking plate 110 after the passage of the predetermined time t3 (after the predetermined time) from time T2 when the uppermost position of the sheet is not detected by the sheet-surface detecting portion 28.

The input portion 19 allows users to input various types of information including the thickness, size, and kind of sheets accommodated in the sheet cassette 11. The sheet-surface detecting portion 28 includes the sheet-surface detecting flag 115 and a sensor portion (not illustrated) and constitutes a sheet detecting portion that detects the uppermost position of the sheets stacked on the sheet stacking plate 110. The feeding roller driving motor is turned on and driven when a feed drive signal 123 (see FIG. 12) is sent by the controller 26 and rotates the feeding roller 9 in the direction for feeding sheets.

Figure 3:
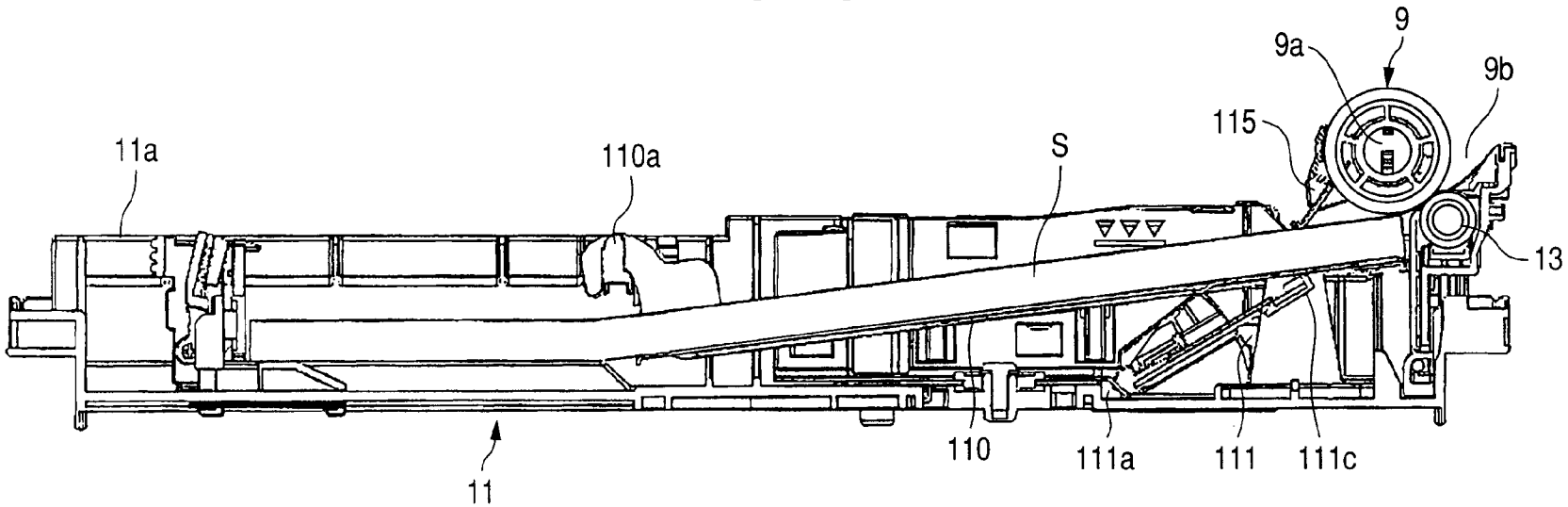
FIG. 3 illustrates a sectional view of a sheet cassette in the first embodiment.

FIG. 3 illustrates the detailed structure of the sheet cassette 11 according to the present embodiment. As illustrated in FIG. 3, the sheet feeding portion of the feeding and conveying device 24 is provided with the sheet cassette 11 that is mounted on the apparatus main body 100A and the feeding roller 9 that is disposed above the sheet cassette 11 so as to feed the sheets S stacked on the sheet stacking plate 110 of the sheet cassette 11. The feeding roller 9 is configured by one roller that functions as both a pickup roller and a feed roller.

Figure 6A:
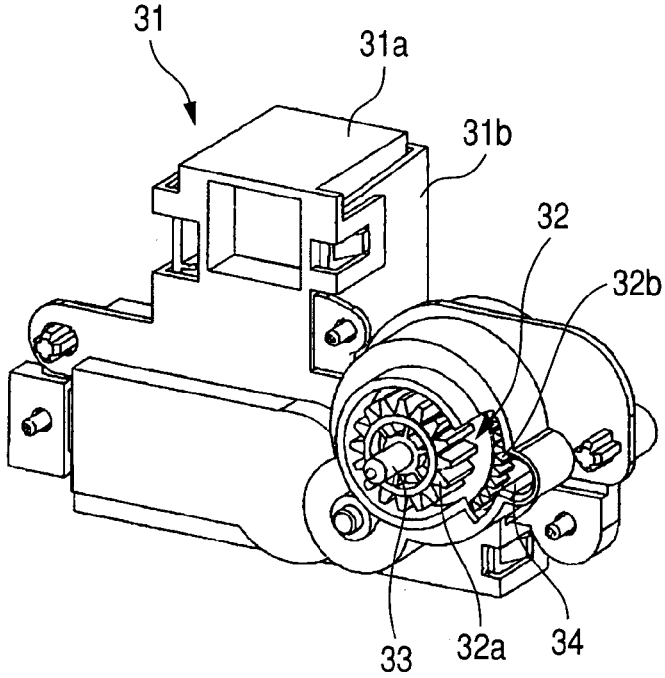
Figure 6B:
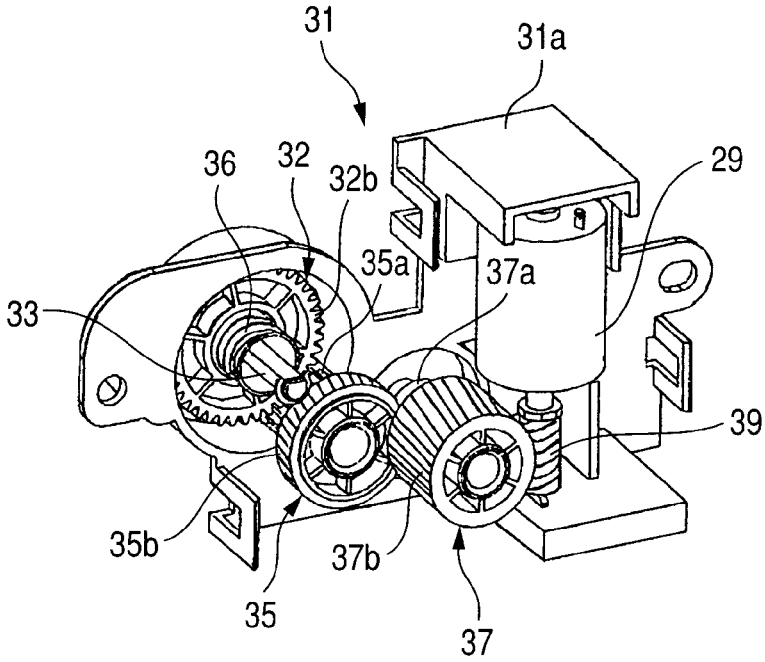

The sheet cassette 11 includes a cassette main body 11*a* that accommodates the sheets S and the sheet stacking plate 110 that stacks the sheets S thereon in a state of being supported to be pivotable (movable up and down) upward and downward about a shaft portion 110*a* that is provided approximately at the center of the cassette main body 11*a*. The sheet stacking plate 110 is pivoted (raised) upward by being pressed by a pressing portion 111*c* of a pressing lever 111 that is driven by the lift motor 29 (FIGS. 2, 6A and 6B). When the sheet stacking plate 110 is pivoted upward, the leading ends of the sheets S stacked on the sheet stacking plate 110 are pressure contacted with the feeding roller 9. In FIG. 3, the shaft 9*a* is provided in the feeding roller 9. A conveying portion 9*b*, and a separation roller 13 are provided. Although in the present embodiment, sheets are separated by the separation roller 13, a separation pad may be used.

Figure 4:
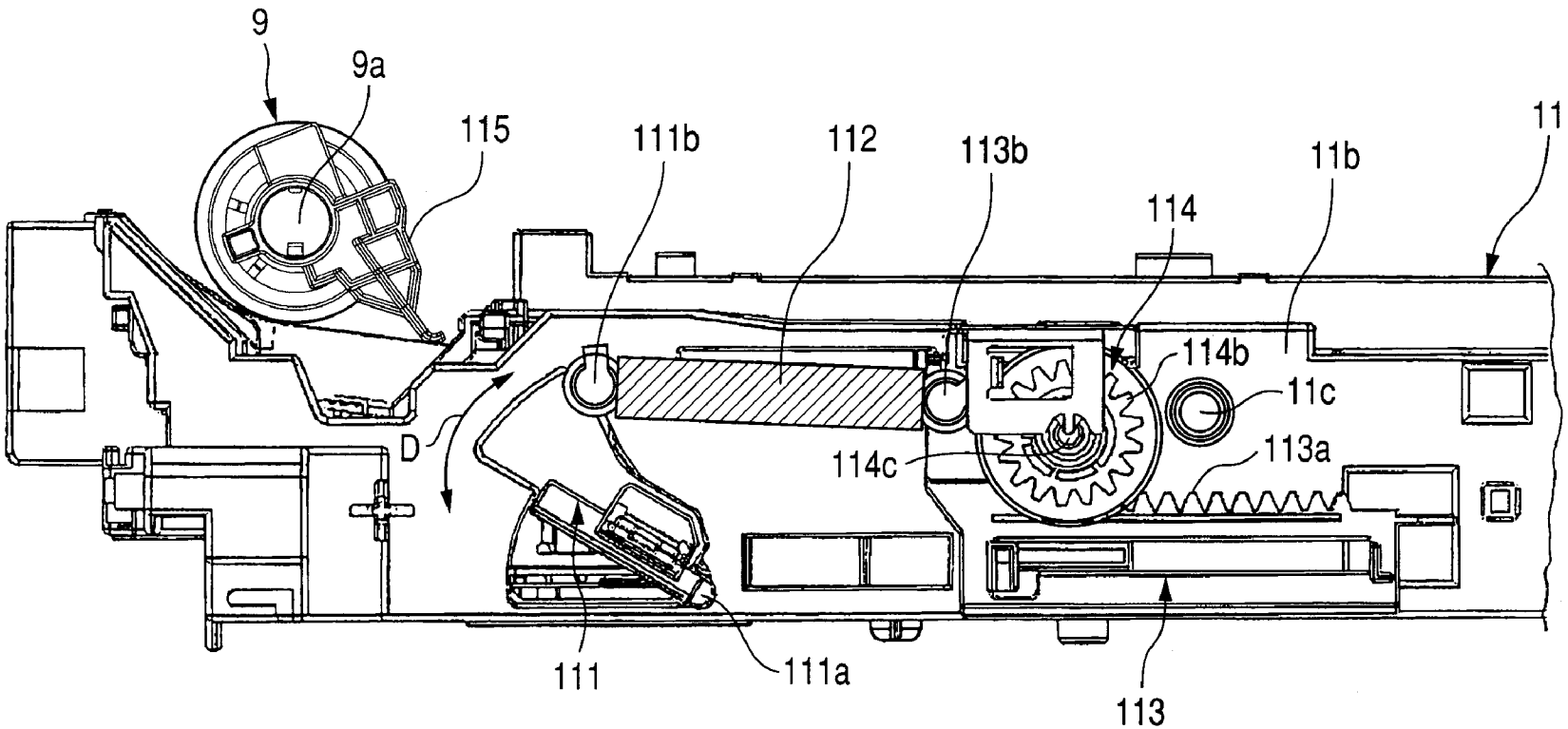
FIG. 4 illustrates a sectional view illustrating the details of a lifting structure of a sheet stacking plate of the sheet cassette.
Figure 5:
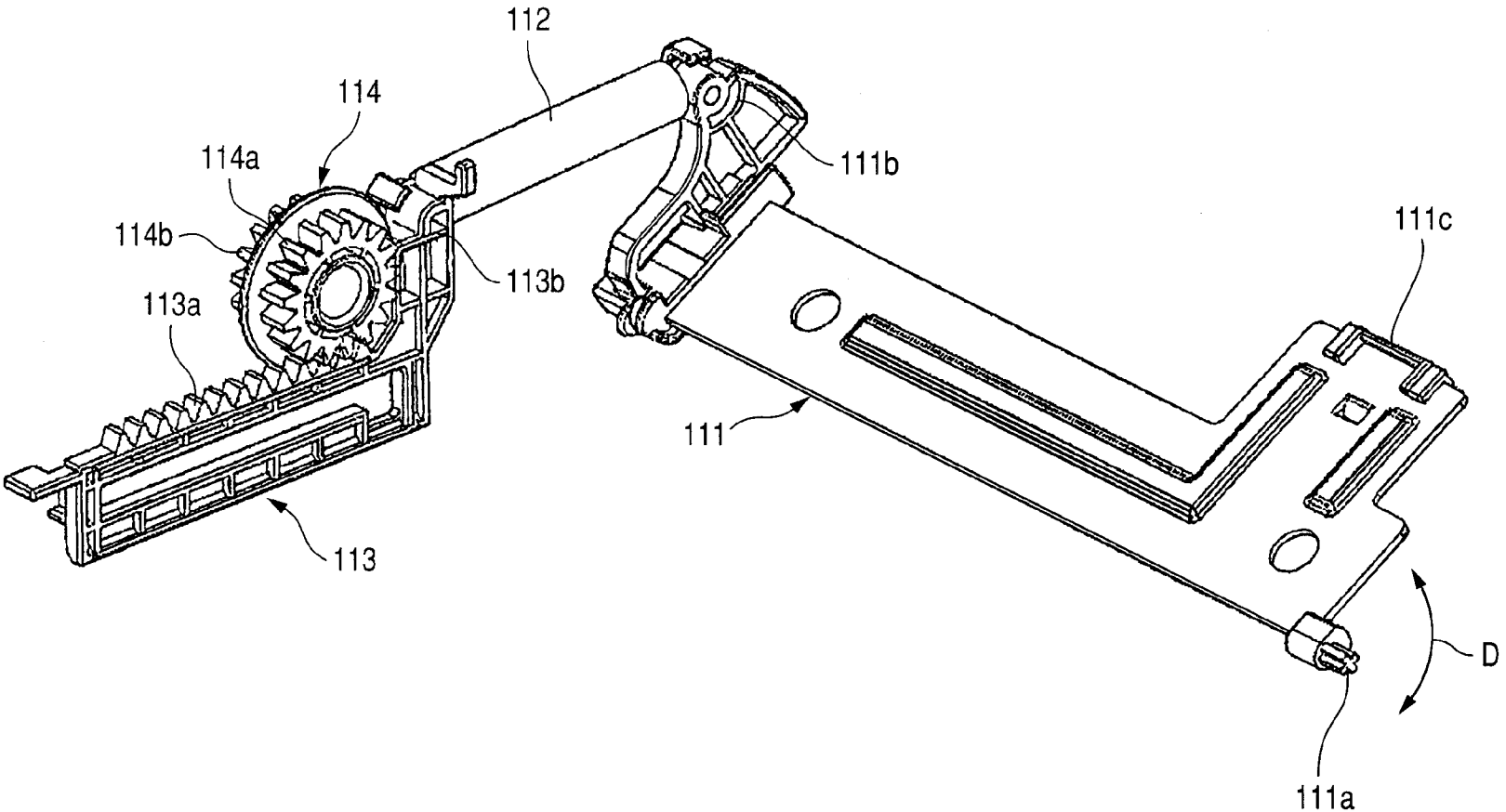
FIG. 5 illustrates a perspective view illustrating the details of the lifting structure of the sheet stacking plate.

Next, the configuration of the sheet cassette 11 will be described with reference to FIGS. 4 and 5, mainly for the configuration that lifts the sheet stacking plate 110. A cassette gear 114 is rotatably supported on a rear wall 11*b* that is disposed on the opposite side of the cassette main body 11*a* illustrated in FIG. 3. When a pressing lever drive signal is sent from the controller 26, the lift motor 29 is driven in response to this to rotate the cassette gear 114. Thus, a rack 113 having its tooth portion 113*a* engaged with the cassette gear 114 is slid in the rightward direction in FIG. 4. A boss portion 113*b* formed on the rack 113 and a boss portion 111*b* formed on the pressing lever 111 are connected by a spring 112 which is a tension spring. When the rack 113 is slid, the pressing lever 111 which is supported on the cassette main body 11*a* to be pivotable about a shaft portion 111*a* is pivoted upward and downward (the directions indicated by arrow D). The pressing lever 111 causes the pressing portion 111*c* at a distal end thereof to come into contact with the lower surface of the sheet stacking plate 110 so that during the pivot operation, the sheet stacking plate 110 is lifted by being pivoted upward and downward about the shaft portion 110*a*. The pressure-contact force (feeding pressure) by which sheets are pressure contacted with the feeding roller 9 is set by the elastic force of the spring 112.

A lifting mechanism that is disposed on the apparatus main body 100A side so as to lift the sheet stacking plate 110 will be described with reference to FIGS. 6A and 6B. As illustrated in FIGS. 6A and 6B, the driving unit 31 constitutes the lifting mechanism that lifts the sheet stacking plate 110 to bring into the sheets contact with the feeding roller 9 and to move the sheets away from the feeding roller 9. The driving unit 31 has a front frame 31*a* and a rear frame 31*b*, and mechanisms such as gears are disposed between the front and rear frames 31*a* and 31*b*. A drive transmission gear 32 engages with the cassette gear 114 (see FIGS. 4 and 5). The drive transmission gear 32 has a small-diameter gear 32*a* that engages with a large-diameter gear 114*b* and a large-diameter gear 32*b* that is formed on the same shaft as the small-diameter gear 32*a* so as to engage with a small-diameter gear 35*a*. The drive transmission gear 32 is supported to rotate around a drive transmission shaft 33. The drive transmission shaft 33 is inserted into a through-hole 11*c* (see FIG. 4) formed in the rear wall 11*b* in a state where the sheet cassette 11 is mounted on the apparatus main body 100A. A hole portion 34 formed at one side portion of the periphery of the drive transmission gear 32 is fitted to a shaft portion 114*c* that protrudes in the axial direction of the large-diameter gear 114*b*. With this configuration, the inter-shaft distance between the drive transmission gear 32 and the cassette gear 114 can be maintained accurately, so that a driving force from the driving unit 31 can be smoothly transmitted to the sheet cassette 11 side.

The drive transmission gear 32 is urged by a gear spring 36 provided around the drive transmission shaft 33 so as to protrude from the driving unit 31 towards the sheet cassette 11. With this configuration, when the large-diameter gear 114*b* and the small-diameter gear 32*a* do not engage properly at the time of inserting the sheet cassette 11 in the apparatus main body 100A, the drive transmission gear 32 is retracted against the urging force of the gear spring 36, thus preventing damages to the large-diameter gear 114*b* and the small-diameter gear 32*a*. When the drive transmission gear 32 is retracted, the large-diameter gear 114*b* of the cassette gear 114 engages with the small-diameter gear 32*a* with the rotation of the lift motor 29. The large-diameter gear 32*b* on the same shaft as the small-diameter gear 32*a* engages with a small-diameter gear 35*a* of a reduction gear 35. A large-diameter gear 35*b* on the same shaft as the small-diameter gear 35*a* is supported so as to engage with a small-diameter gear 37*a* of a reduction gear 37. A large-diameter gear 37*b* on the same shaft as the small-diameter gear 37*a* is supported so as to engage with a warm gear 39.

The reduction gears 35 and 37 are disposed so as to rotate on their shafts supported on the rear frame 31*b*, and the respective shafts are fitted to holes formed in the front frame 31*a*, whereby the positions thereof are determined. The lift motor 29 is a motor that rotates the warm gear 39 attached around a rotating shaft thereof and is positioned and fixed to the front frame 31*a*. In the present embodiment, since the warm gear 39 used as a reduction unit provides a large reduction ratio, it is possible to decrease the size of the driving unit 31.

The configuration of the sheet-surface detecting portion will be described in detail with reference to FIGS. 7 and 8. As illustrated in FIG. 8, the sheet-surface detecting portion 28 (see FIG. 2) includes the sheet-surface detecting flag 115 disposed at one end of the feeding roller 9 and a sensor portion (not illustrated). The sheet-surface detecting flag 115 is supported to be pivotable about a shaft 9*a* and has a sheet contact 115*a* which makes contact with an uppermost sheet S by hanging downward towards a portion on the upstream side in the sheet feeding direction due to its own weight. The sensor portion (not illustrated) detects a sheet surface position based on detecting the rotation of the sheet-surface detecting flag 115. Instead of this method, the sheet-surface detecting portion 28 may be configured using an optical reflection method and an ultrasonic position detecting method, for example.

Figure 7:
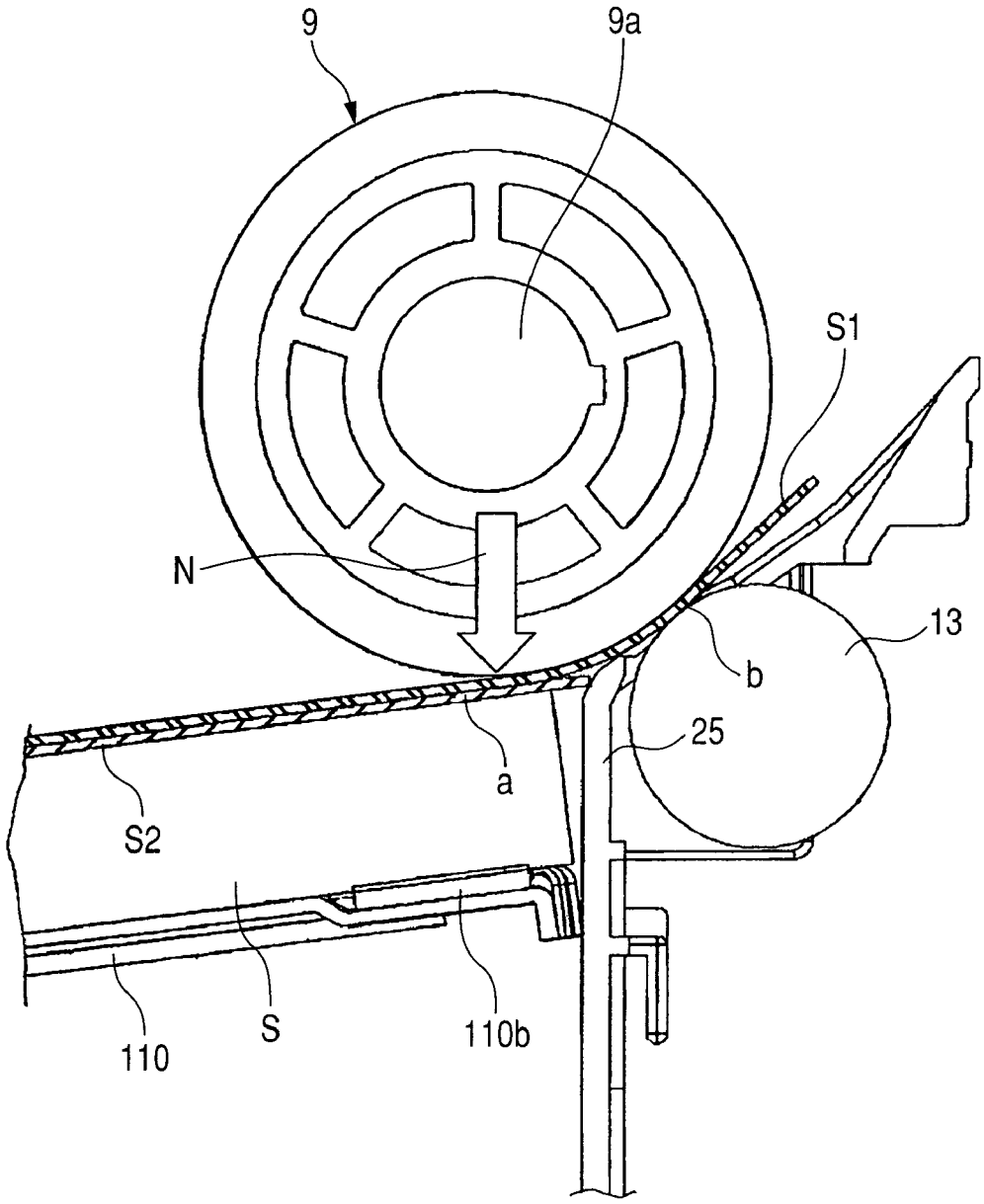
FIG. 7 illustrates a sectional view illustrating the details of a configuration that feeds and separates sheets in the first embodiment.
Figure 8:
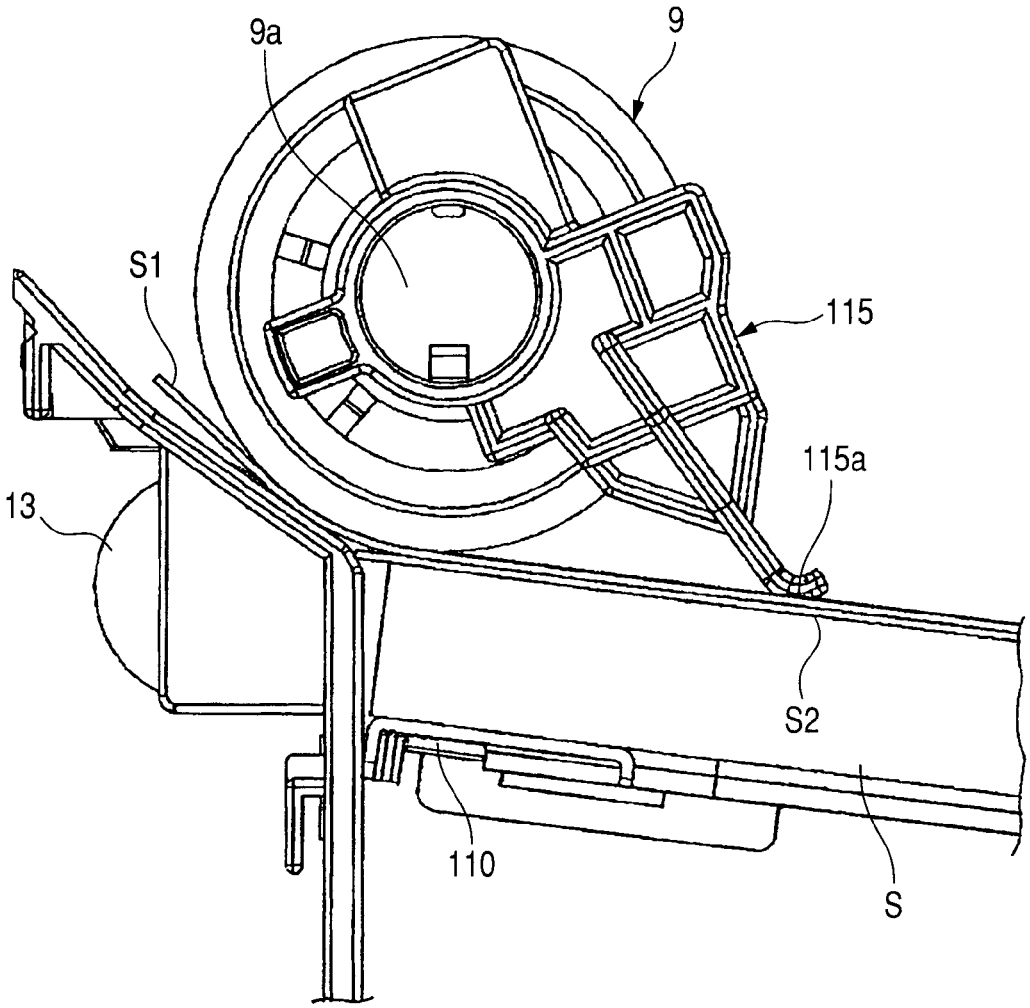
FIG. 8 illustrates a sectional view illustrating the detailed configuration of a sheet-surface detecting portion.

As illustrated in FIG. 7, in the sheet cassette 11, the separation roller 13 which is rotatable and pressed toward the feeding roller 9 by the urging force of the spring (not illustrated) is disposed. The separation roller 13 is in contact with the feeding roller 9 at point b on the downstream side in the sheet feeding direction. The feeding roller 9 is in contact with the sheet S on the sheet stacking plate 110 at point a, and on the downstream side in the sheet feeding direction, is also in contact with the separation roller 13 at point b (hereinafter referred to as separation nip b). Thus, the feeding roller constitutes a separation portion that separates sheets fed from the feeding roller 9. In this way, since the separation roller 13 is pressure contacted with the feeding roller 9, the sheets S1 fed by the feeding roller 9 rotated by the driving force from the feeding roller driving motor (see FIG. 2) are separated one by one, and the separated sheet S1 is conveyed towards the downstream direction. The separation roller 13 is fixed via a torque limiter (not illustrated). When no sheet or only one sheet is present at the separation nip b, by the function of the torque limiter, the separation roller 13 rotates in the sheet feeding direction in an accompanied manner with the feeding roller 9 or the sheet being fed. When two or more sheets are inserted at the separation nip b at the same time, by the function of the torque limiter, the separation roller 13 stops rotating and regulates sheets other than the sheet in contact with the feeding roller 9, thus separating the sheets one by one.

Figures 9, 10:
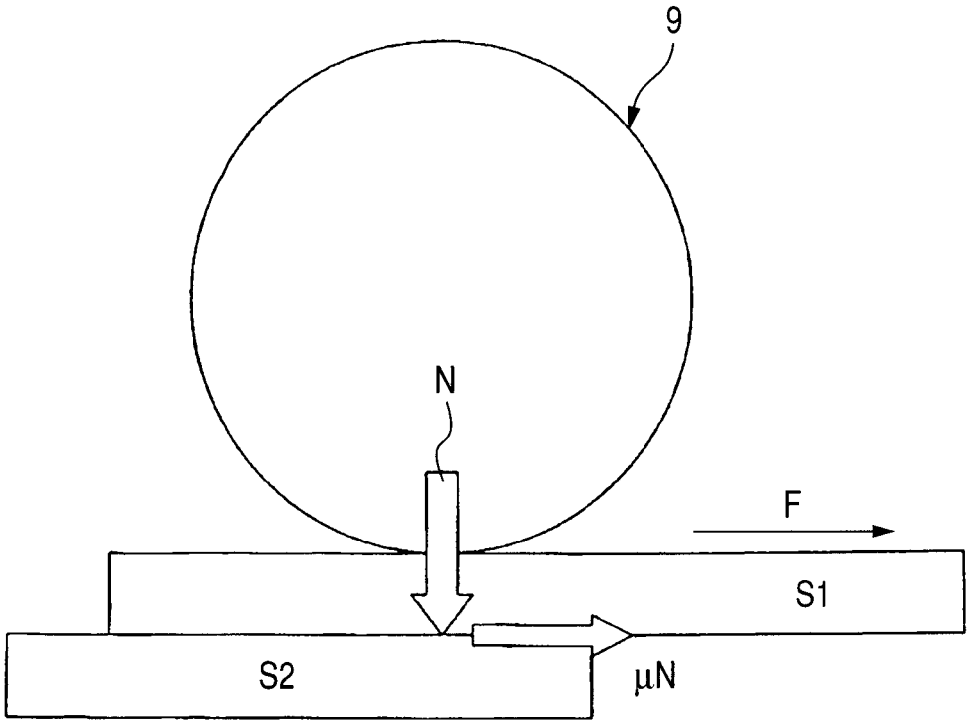
FIG. 9 illustrates a schematic diagram illustrating a frictional force that is applied between the sheets by a sheet feeding portion.
FIG. 10 illustrates a table illustrating an example of a pressure-contact time in the first embodiment.

As illustrated in FIG. 9, in a state where a sheet S1 separated from a sheet bundle is conveyed in the sheet feeding direction indicated by arrow F by the rotation of the feeding roller 9, when the sheet bundle is continuously pressure contacted with the feeding roller 9, the following problems may occur. That is, a frictional force μN based on contact force N is generated between the sheet S1 being fed and a next sheet S2 remaining in the stacked state to be fed subsequently. Thus, the sheet S2 is moved in the sheet feeding direction F following the movement of the sheet S1 by the effect of the frictional force μN (this movement will be referred to as an accompanied movement). In this case, when the sheet S2 reaches the separation nip b, it will be fed without being separated, thus causing a multiple feeding.

As illustrated in FIG. 7, even when the next sheet S2 being fed by the frictional force is not caught at the separation nip b, the leading end of the next sheet S2 will come into contact with a conveyance guide 25 disposed on the upstream side of the separation roller 13. In this case, if the sheet S2 is a thick sheet, it will not be easily buckled due to its rigidity. However, if the sheet S2 is a thin sheet which has weak rigidity, it will be easily buckled by the effect of the frictional force μN, and thus the leading end thereof will be folded or rolled. Since a sheet S which is thick and rigid is not easily caught at the separation nip b, it is necessary to convey the sheet until it is caught at the separation nip b properly. Therefore, for a thin sheet which is easily folded and rolled at the leading end and causes a multiple feeding, the pressure-contact time t2 during which the sheet is pressure contacted to the feeding roller 9 is set to be short so as to decrease the amount of accompanied movement. On the other hand, for a thick sheet which is rarely rolled at the leading end and is not easily inserted at the separation nip b, the pressure-contact time t2 is set to be longer so that the sheet is certainly inserted at the separation nip b. In the present embodiment, the sheet feeding condition is optimized in accordance with the rigidity of sheets.

In general, the thickness and rigidity of sheets correlates (is substantially proportional) with the basis weight of sheets, the sheet feeding condition can be set based on the class of the basis weight of the sheets. An example of the pressure-contact time t2 (see FIG. 12) is illustrated in FIG. 10. In the present embodiment, as illustrated in FIG. 10, the thin sheet means a sheet having a basis weight of 55 g/m$^2$ to 75 g/m$^2$, and a normal sheet means a sheet having a basis weight of 75 g/m$^2$ to 105 g/m$^2$ and generally used in offices. The thick sheet means a sheet having a basis weight of 105 g/m$^2$ to 250 g/m$^2$ which is higher than the basis weight of the normal sheet. In relation to the pressure-contact time t2 stored in the memory 18, the rigidity of sheets is set based on the basis weight or thickness of the sheets, and the pressure-contact time t2 increases gradually as the basis weight or thickness increases.

The pressure-contact time t2 corresponding to the kind of sheets is set in advance as described below and stored in the memory 18 as information on the pressure-contact time t2 with the feeding roller 9, of the sheets S on the sheet stacking plate 110. Specifically, the pressure-contact time t2 is set to 0.2 (sec) for the thin sheet having the basis weight of 55 g/m$^2$ to 75 g/m$^2$, and the pressure-contact time t2 is set to 0.25 (sec) for the normal sheet having the basis weight of 75 g/m$^2$ to 105 g/m$^2$. The pressure-contact time t2 is set to 0.3 (sec) for the thick sheet having the basis weight of 105 g/m$^2$ to 250 g/m$^2$. However, since the feeding performance differs depending on the configuration of the apparatus, the thin, normal, and thick sheets may be defined differently in individual apparatuses without being limited to the above example. Furthermore, the thin and thick sheets may be more finely classified in accordance with the basis weight or thickness, and the pressure-contact time which is suitable for the respective classes may be set.

As described above, the kinds of sheets are classified in accordance with the basis weight or thickness of the sheets, and the pressure-contact time t2 of a class of sheets having a smaller basis weight or thickness is set to be shorter than the pressure-contact time t2 of a class of sheets having a larger basis weight or thickness. In this way, damages to sheets can be prevented by certainly feeding sheets having the larger basis weight or weight to the conveying roller 10 and quickly releasing the feeding pressure applied to the sheets having the smaller basis weight or thickness.

Figure 11:
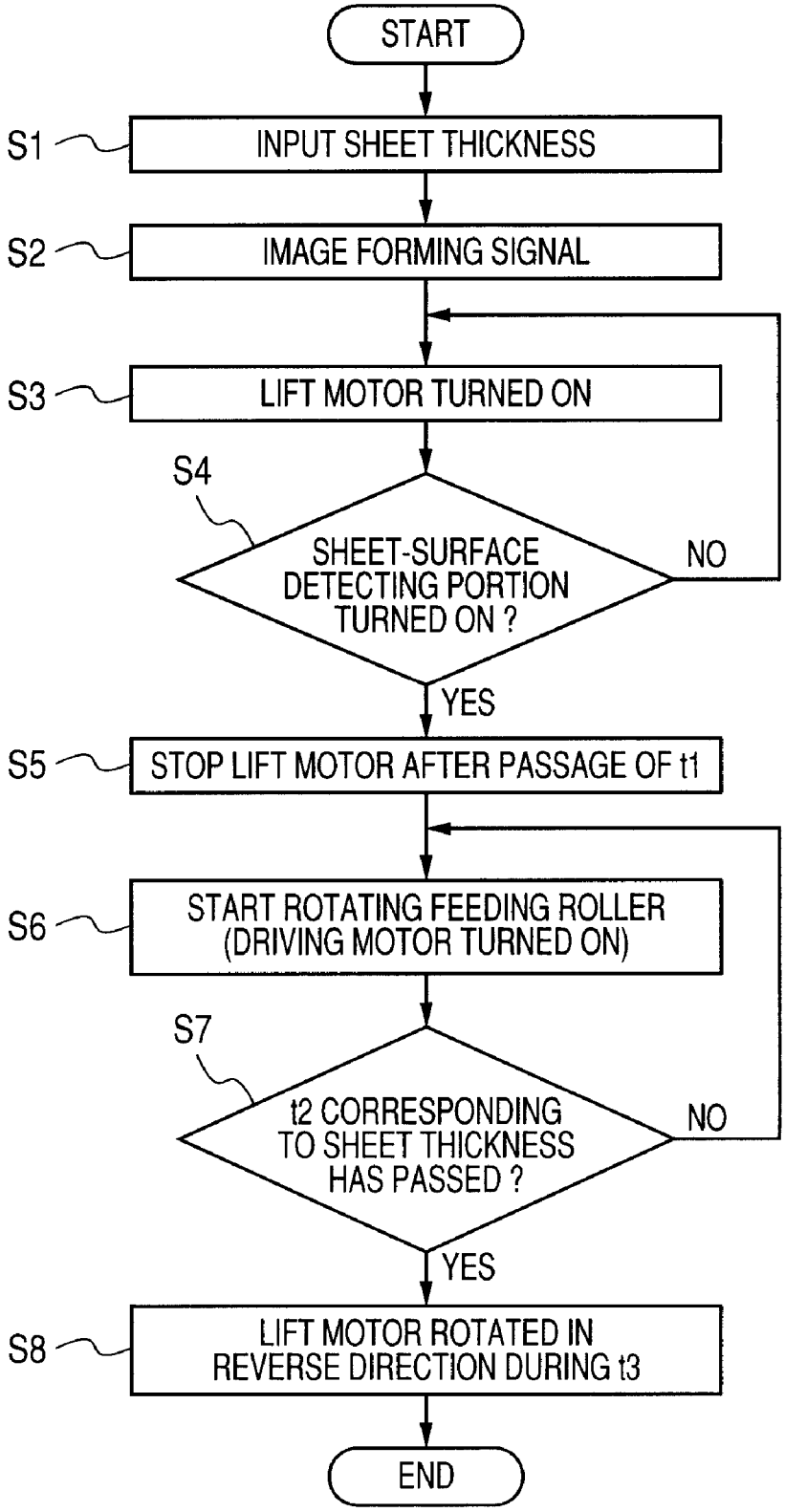
FIG. 11 illustrates a flowchart illustrating the operations in the first embodiment.

The operations of the present embodiment will be described with reference to the flowchart in FIG. 11 and the time chart (sequence chart) in FIG. 12. In the image forming apparatus 100, when a user operates the input portion 19 to input the thickness of a sheet (step S1), the controller 26 generates an image forming signal 121 in response to this (step S2). Then, a lift drive signal 124 is sent, and in response to this, the lift motor 29 is driven to rotate the cassette gear 114 (step S3), and the sheet-surface detecting portion 28 is turned on (step S4). The pressing lever 111 is pivoted in the positive-rotation direction (clockwise direction in FIG. 4) with the boss portion 111*b* being pulled by the rack 113 and the spring 112, and the sheet stacking plate 110 is moved up towards the feeding roller 9. The controller 26 starts counting the pressure-contact time t2 (FIG. 12) after the passage of the predetermined time t1 (after the predetermined time) from time T1 when it is determined that the uppermost surface of the sheet bundle has stopped rising based on a sheet-surface detection signal 122 from the sheet-surface detecting flag 115. At the same time, the rotation of the lift motor 29 is stopped to stop the driving of the pressing lever 111 (step S5). In this way, a constant feeding pressure is realized regardless of the amount of sheets stacked in the sheet cassette 11.

After the driving of the pressing lever 111 is stopped, when the feed drive signal 123 is output by the controller 26, the feeding roller driving motor 30 (FIG. 2) is turned on and driven, whereby the feeding roller 9 starts rotating and a feed driving is started (step S6). At time after the passage of the pressure-contact time t2 from the start of the feed driving (step S7) which is predetermined time corresponding to the sheet thickness input at step S1 from the start of the feed driving, the controller 26 reverses the polarity of the lift drive signal 124. The lift motor 29 rotates in the reverse direction for the predetermined time t3 (step S8), whereby the sheet stacking plate 110 is separated from the feeding roller 9. At that time, the controller 26 turns off the lift drive signal 124 so as to stop the reverse rotation of the lift motor 29 after the passage of the predetermined time t3 from time T2 when the start of the downward movement of the sheet stacking plate 110 is detected based on a change in the sheet-surface detection signal 122 input from the sheet-surface detecting portion 28. That is, the controller 26 starts the downward movement of the sheet stacking plate 110 when the sheets on the sheet stacking plate 110 are separated and stops the downward movement of the sheet stacking plate 110 after the passage of the predetermined time t3 from the time when the sheet-surface detecting flag 115 detects separation of the uppermost sheet. In this way, the driving of the pressing lever 111 is stopped, and the separation amount between the sheets S and the feeding roller 9 can be minimized. Thus, by having the sheets slightly separated from the feeding roller 9, the performance of continuous feeding can be improved.

In the present embodiment, the controller 26 sets the pressure-contact time t2 from the memory 18 in accordance with the rigidity of the sheet to be fed and starts the operation of feeding the sheet by causing the feeding roller 9 to be pressure contacted with the sheet stacked on the sheet stacking plate 110. Moreover, the controller 26 controls the feeding roller 9 to be separated from the sheet stacked on the sheet stacking plate 110 after the passage of the set pressure-contact time t2. Therefore, it is possible to set the optimum contact time at the time of feeding sheets in accordance with the kind of sheet being fed. In this way, it is possible to realize a stable feeding operation. Since the controller 26 controls the driving unit 31 based on a detection signal of the sheet-surface detecting flag 115 that detects the height of the uppermost surface of a sheet bundle, it is possible to stabilize and accelerate the contacting operation.

In the present embodiment, for controlling the driving unit 31, the pressure-contact time is changed using the counter 20 which operates in accordance with various types of information stored in the memory 18 within the controller 26. However, the pressure-contact time may be measured by a mechanical configuration. For example, the timing of moving down the sheet stacking plate 110 may be controlled using a gear train that moves with the start of the movement of the feeding roller 9, and the reduction ratio of the gear train may be changed by a solenoid.

(Second Embodiment)

A second embodiment of the present invention will be described with reference to FIGS. 13 and 14. The present embodiment is different from the first embodiment only in that a half-moon roller is used as the feeding roller. Since the other configurations are approximately the same, the main portions will be denoted by the same reference numerals, and description thereof will be omitted.

Figure 13:
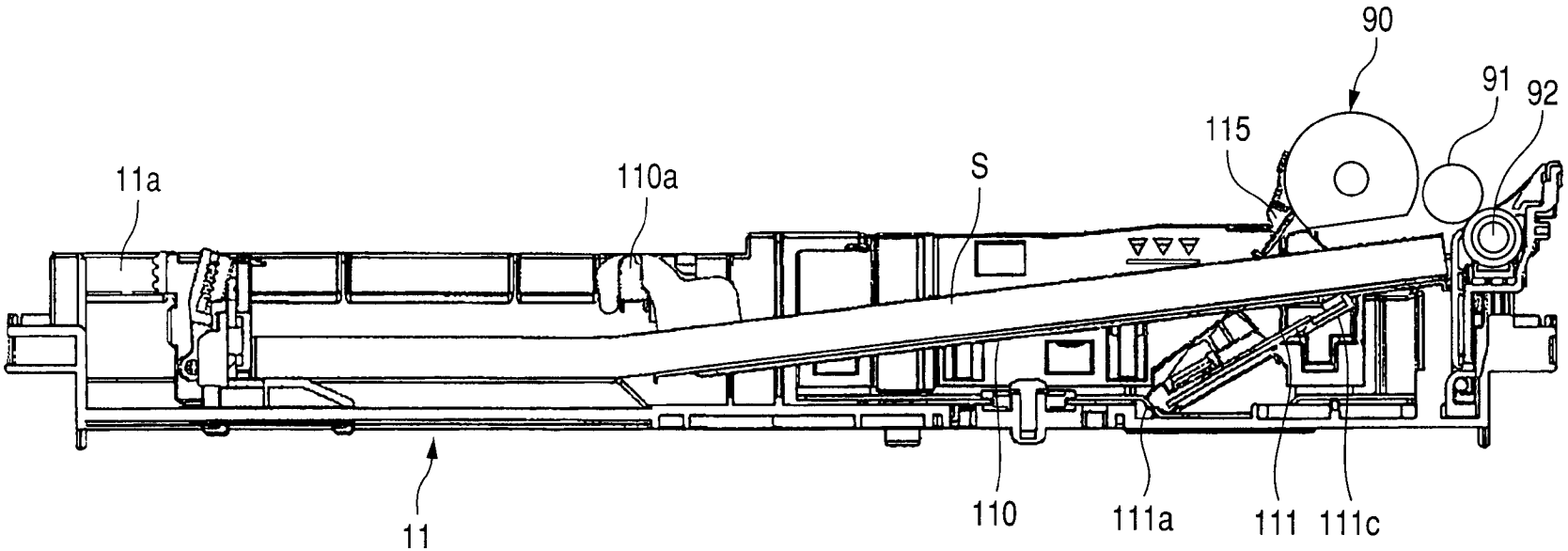
FIG. 13 illustrates a sectional view of a sheet cassette according to a second embodiment of the present invention.

As illustrated in FIG. 13, a feeding roller 90 of the present embodiment is a half-moon roller which is pivotably arranged on the apparatus main body 100A side. The sheets S are fed when the feeding roller 90 is pivoted. The sheets S being fed are conveyed to a separation portion illustrated in FIG. 14. The separation portion includes a feed roller 91 that conveys the sheets S in the sheet feeding direction and a retard roller 92 which always applies a predetermined torque in the direction opposite to the sheet feeding direction by means of a drive transmission portion and a torque limiter which are not illustrated. The retard roller 92 rotates in the sheet feeding direction (clockwise direction in FIG. 14) when a predetermined torque is applied thereto and conveys a sheet S1 caught between the feed roller 91 and the retard roller. When a plurality of sheets comes to be positioned at the nip between the feed roller 91 and the retard roller 92, the torque transmitted to the retard roller 92 becomes a predetermined torque or smaller by the effect of a frictional force between the sheets. Therefore, the second and subsequent sheets coming to be positioned at the nip will be returned towards the upstream side in the sheet feeding direction.

Figure 14:
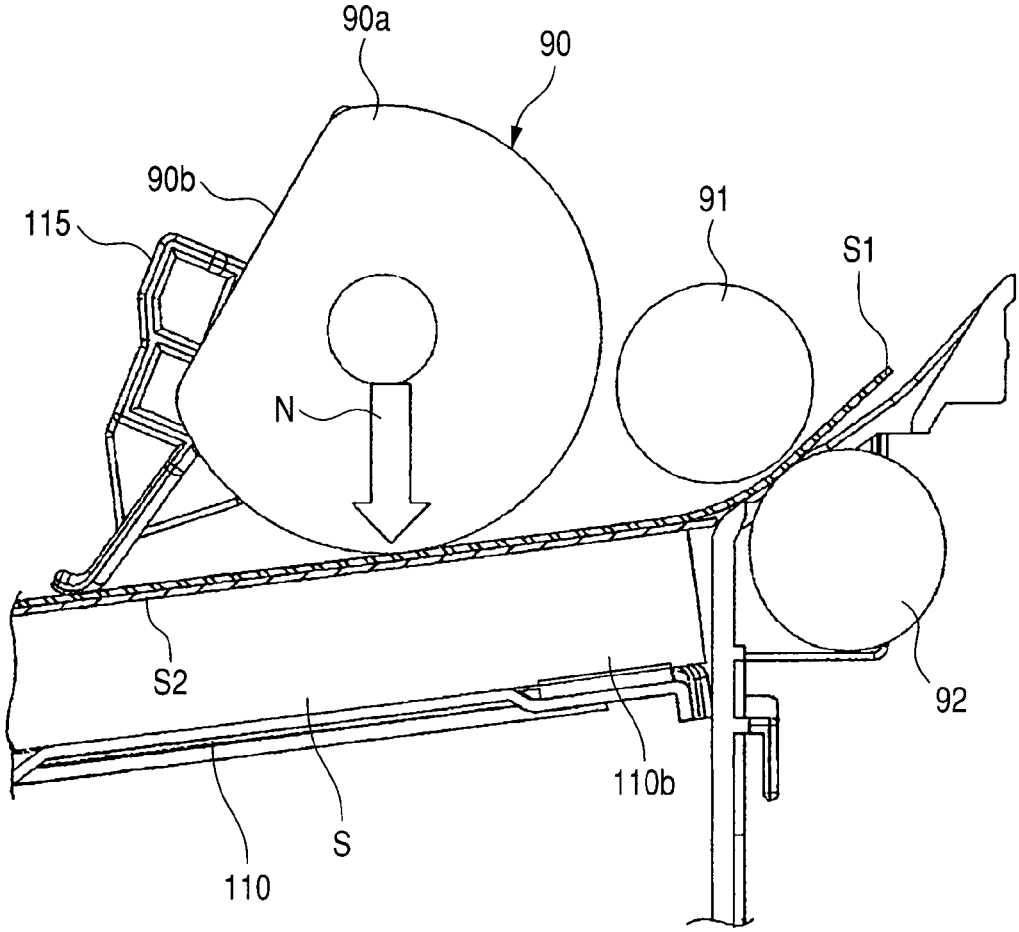
FIG. 14 illustrates a sectional view illustrating the details of a configuration that feeds and separates sheets in the second embodiment.

In the related art, since a sheet contacting pressure is generated at a portion of the sheet S1 being in contact with a circular feeding area 90*a* of the feeding roller 90 illustrated in FIG. 14, sheets may not be properly returned by the retard roller 92 depending on the kind of the sheets. Some sheet may be rolled between a portion in contact with the feeding roller 90 and a portion in contact with the feed roller 91 and the retard roller 92. In a flat non-feeding area 90*b* of the feeding roller 90, since the sheet contacting pressure is not generated between the sheet and the feeding roller 90, the feeding of sheets is not inhibited.

In the present embodiment, the time during which the feeding area 90*a* of the feeding roller 90 is in contact with the sheet S1 is configured to be identical to the maximum pressure-contact time of the corresponding sheet. By doing so, the operation of separating the sheet stacking plate 110 is not necessary for a thick sheet having the longest contact time, and thus the sheet feeding performance can be improved. On the other hand, when a thin sheet is fed, the sheet stacking plate 110 is separated during a period when the feeding area 90*a* of the feeding roller 90 is in contact with the sheet. The time chart corresponding to a thin sheet according to the present invention is as illustrated in FIG. 12. In this case, with regard to the sheet stacking plate 110 separation operation, the pressure-contact time t2 is set in accordance with the kind of sheets, and the separating operation is started during a period when the feeding area 90*a* of the feeding roller 90 is in contact with the sheet. In the present embodiment, substantially the same advantages as in the first embodiment can be obtained.

(Third Embodiment)

A third embodiment of the present invention will be described with reference to FIGS. 15A, 15B, 15C and 16. The present embodiment is different from the first embodiment in that the sheets on the sheet stacking plate are not separated from the feeding roller, but the feeding roller is separated from the sheets on the sheet stacking plate. The basis configuration of the image forming apparatus 100 illustrated in FIG. 1 is the same.

In the present embodiment, a controller 46 lifts a sheet stacking plate (sheet stacking portion) 201 so that the uppermost position of the stacked sheets is maintained at a predetermined feeding position. In the present embodiment, a pickup roller (feeding roller) 53 is provided to be movable up and down so as to feed a sheet by being pressure contacted with the upper surface of the sheet stacked on the sheet stacking plate 201 when the pickup roller is moved downward. The pickup roller 53 is moved upward after the passage of the pressure-contact time t2, whereby the pickup roller 53 is separated from the sheets stacked on the sheet stacking plate 201.

Figure 15A:
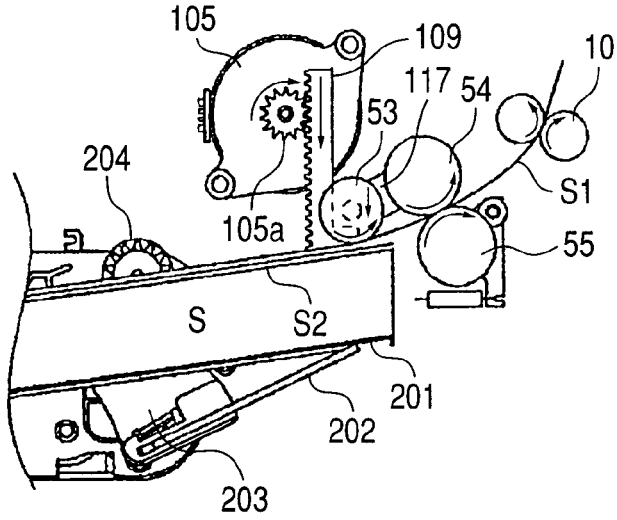
FIGS. 15A, 15B and 15C illustrate side views illustrating the details of a configuration that feeds and separates sheets in a third embodiment of the present invention.
Figure 15B:
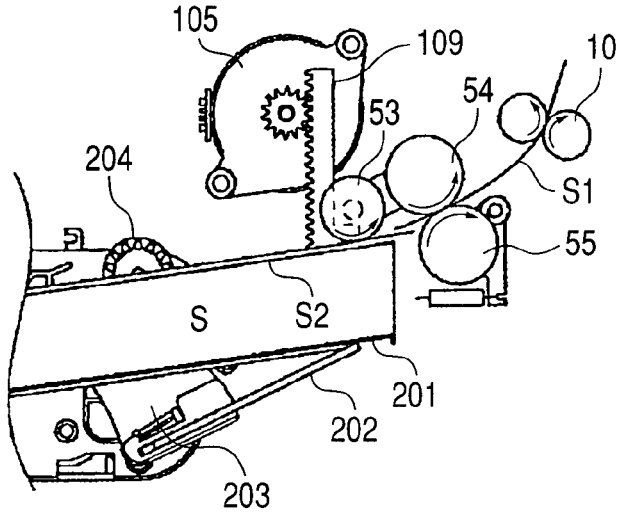
Figure 15C:
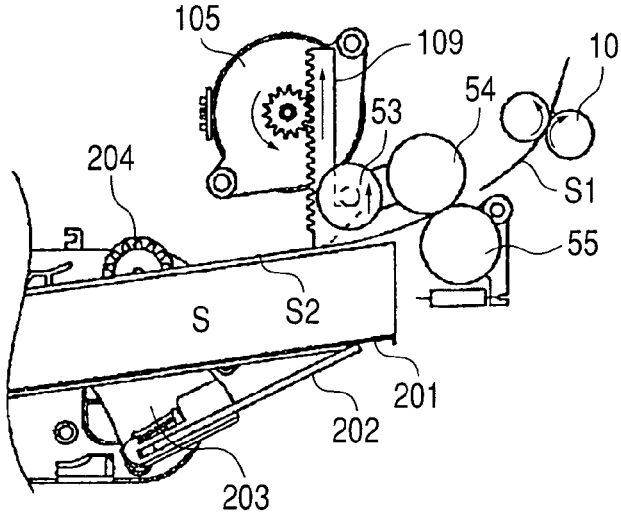

As illustrated in FIGS. 15A, 15B, and 15C, the sheet stacking plate 201 is provided on the frame of the sheet cassette (not illustrated in FIGS. 15A to 15C) to be pivotable upward and downward. The sheet stacking plate 201 is pivoted upward and downward by an upward pressing plate 202 provided thereunder. A fan-shaped gear 203 is provided at one end of the upward pressing plate 202. The fan-shaped gear 203 engages with a pinion 204 that is rotated by a lift motor 210. When the fan-shaped gear 203 rotates with the rotation of the pinion 204, the upward pressing plate 202 is pivoted and the sheet stacking plate 201 is moved upward. A sheet-surface detecting portion 116 (see FIG. 16) which is not illustrated in FIGS. 15A to 15C is provided so as to detect the uppermost position of the sheets. When the sheet-surface detecting portion 116 is in the non-detection state, the controller 46 controls the lift motor 210 so that the sheet stacking plate 201 is moved up, to a position where the uppermost one of the sheets S is positioned at a height such that appropriate pressure is applied when the sheet is being fed, by the upward pressing plate 202 of a lifting portion.

Figure 16:
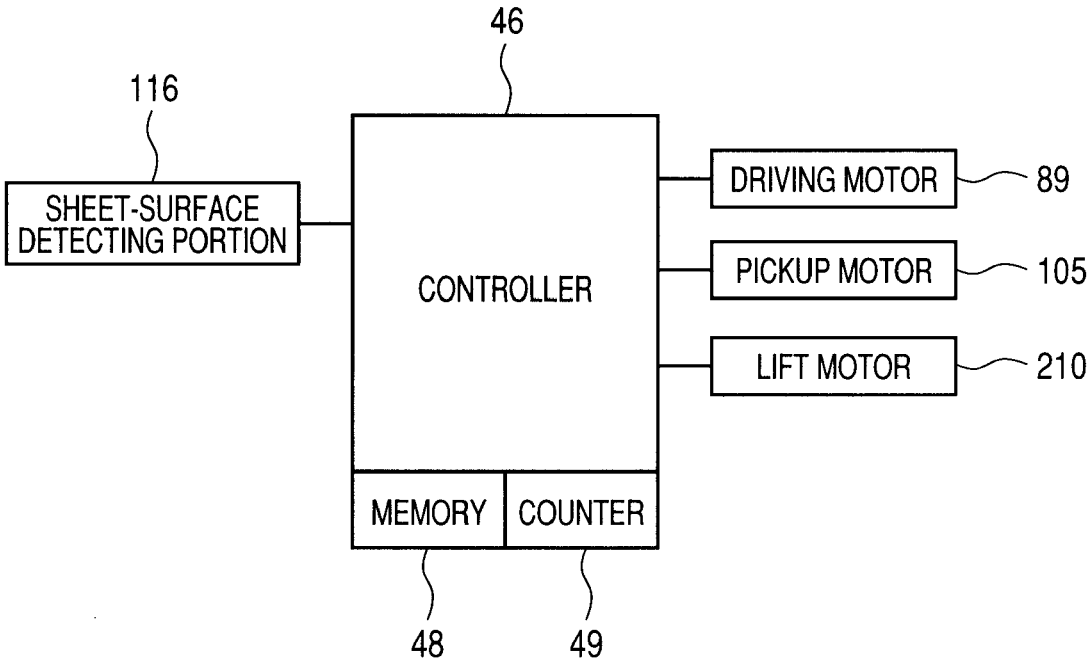
FIG. 16 illustrates a block diagram of a control system in the third embodiment.

The controller 46 of the present embodiment includes a memory 48 and a counter 49 as illustrated in FIG. 16. The controller 46 receives a signal from the sheet-surface detecting portion 116 and sends a drive signal to a driving motor 89, a pickup motor 105, and a lift motor 210. The sheet-surface detecting portion (sheet detecting portion) 116 includes a sheet-surface detecting flag (not illustrated) and a sensor portion (not illustrated). When sheets are sequentially fed, and the sheet-surface detecting portion 116 is in the non-detection state, the controller 46 repeatedly controls the lifting portion to move up the sheet stacking plate 201 so that the uppermost position of the sheets is at a predetermined position.

The memory 48 constitutes an information storage portion that stores information on a pressure-contact time t2 with the pickup roller 53, of the sheets stacked on the sheet stacking plate 201, which is set in advance so as to increase as the rigidity of the sheet increases. In the present embodiment, it is basically possible to use the time chart in FIG. 12, and the same time can be used for the predetermined time t1, the pressure-contact time t2, and the predetermined time t3. However, the pickup roller 53 is operated in synchronization with the respective times rather than the sheet stacking plate 201.

As illustrated in FIGS. 15A, 15B, and 15C, the pickup roller 53 is arranged so as to feed an uppermost sheet S1 of the sheet bundle S stacked on the sheet stacking plate 201. In addition, a separation portion is provided including a feed roller 54 and a retard roller 55 that separate sheets fed by the pickup roller 53. In the separation portion, when no sheet or only one sheet is inserted at the nip between the feed roller 54 and the retard roller 55, the retard roller 55 rotates in an accompanied manner with the feed roller 54. When two or more sheets are inserted at the nip, the retard roller 55 rotates in the direction opposite to the sheet feeding direction, thus separating the sheets one by one.

The pickup roller 53 is movable up and down and held by a roller holder 117 that is rotatably attached to the shaft of the feed roller 54. The pickup motor 105 is arranged in a state where a pinion gear 105*a* fixed to a rotating shaft thereof engages with a rack 109 that is slidable up and down so as to move up and down the pickup roller 53 that is provided to be movable up and down. The rack 109 engages with an end of the roller holder 117 that holds the pickup roller 53. When the rack 109 is slid upward, the roller holder 117 is moved upward. When the controller 46 drives the pickup roller 105, the rack 109 is moved so as to raise the pickup roller 53, whereby the pickup roller 53 is separated from the upper surface of the uppermost sheet S. When the controller 46 drives the pickup motor 105 in the reverse direction, the pickup roller 53 comes into contact with the uppermost surface of the sheet.

The present invention can be implemented using such a configuration. That is, the pressure-contact time t2 during which the pickup roller 53 is in contact with the uppermost surface of a sheet is set to be long for sheets having large rigidity, whereas the pressure-contact time t2 during which the pickup roller 53 is in contact with the uppermost surface of a sheet is set to be short for sheets having small rigidity. This is performed by changing the driving timing for lifting the pickup roller 53 with the pickup motor 105. That is, in the present embodiment, the controller 46 sets the pressure-contact time t2 from the memory 48 in accordance with the rigidity of the sheet and starts the operation of feeding the sheet by causing the pickup roller 53 to be pressure contacted with the sheet stacked on the sheet stacking plate 201. Moreover, the controller 46 causes the pickup roller 53 to be separated from the sheet stacked on the sheet stacking plate 201 after the passage of the set pressure-contact time t2. With this configuration, substantially the same advantages as in the first embodiment can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-185131, filed Aug. 7, 2009, which is hereby incorporated by reference herein in its entirety.

What is claimed is:

1. An image forming apparatus comprising:

a sheet stacking portion that stacks sheets thereon;

a feeding roller that pressure contacts with and separates from the stacked sheets, and the feeding roller configured to feed a sheet by being pressure contacted with the sheet;

a separation portion that separates sheets being fed from the feeding roller;

an information storage portion that stores information on a pressure-contact time of the stacked sheets with the feeding roller, the time being set in advance so as to increase as rigidity of the sheet increases; and a controller that sets the pressure-contact time from the information storage portion in accordance with the rigidity of the stacked sheets which is inputted by an input portion, starts a feeding operation of the sheet by causing the feeding roller to be pressure contacted with the stacked sheets, and separates the feeding roller from the stacked sheets after the passage of the set pressure-contact time.

2. The image forming apparatus according to claim 1, wherein:

the sheet stacking portion is movable up and down in a state where the sheets are stacked thereon, an elastic member is provided so as to urge the sheet stacking portion towards the feeding roller, the stacked sheets are pressure contacted with the feeding roller by elastic force of the elastic member, and the sheet stacking portion is moved down against the elastic force of the elastic member after the passage of the pressure-contact time whereby the stacked sheets and the feeding roller are separated.

3. The image forming apparatus according to claim 1, further comprising:

a sheet detecting portion that detects an uppermost position of the stacked sheets, and a counter for counting the pressure-contact time, wherein the controller causes the counter to start counting the pressure-contact time after the passage of a predetermined time from the time when the controller moves up the sheet stacking portion and the sheet detecting portion detects the uppermost position of the sheet and moves down the sheet stacking portion when the counter has counted a count number corresponding to the pressure-contact time.

4. The image forming apparatus according to claim 3, wherein the controller starts moving down the sheet stacking portion in order to separate the stacked sheets from the feeding roller, and stops moving down the sheet stacking portion after the passage of a predetermined time from the time when the sheet detecting portion is unable to detect the uppermost position of the sheet.

5. The image forming apparatus according to claim 1, wherein:

the sheet stacking portion is controlled to move up and down so that the uppermost position of the stacked sheets is maintained at a predetermined feeding position;

the feeding roller is movable up and down and feeds the sheets by being pressure contacted with the upper surface of the stacked sheet when the feeding roller is moved down; and the feeding roller is moved up after the passage of the pressure-contact time, whereby the stacked sheets are separated from the feeding roller.

6. The image forming apparatus according to claim 1, wherein the rigidity of the sheet in the information on the pressure-contact time is set based on a basis weight or thickness of the sheet.

* * * * *